US005731556A

United States Patent [19]

Gardner et al.

[11] Patent Number: 5,731,556

[45] Date of Patent: Mar. 24, 1998

[54] MUFFLER FOR PNEUMATIC DEVICE

[75] Inventors: Richard K. Gardner, Montpelier, Ohio; Joseph W. Sullivan, Lafayette, Ind.; Gerald M. Distel; Roger D. Wieland, both of Bryan, Ohio

[73] Assignee: Ingersoll-Rand Company, Woodcliff Lake, N.J.

[21] Appl. No.: 722,712

[22] Filed: Sep. 30, 1996

[51] Int. Cl.[6] ..... F01N 3/02

[52] U.S. Cl. ..... 181/230; 181/239; 181/272

[58] Field of Search ..... 181/230, 229, 181/224, 225, 239, 252, 256, 257, 258, 264, 268, 270, 272, 281, 282, 269

[56] References Cited

U.S. PATENT DOCUMENTS 1,115,873 11/1914 Spencer ..... 181/270
4,424,883 1/1984 Musiani ..... 181/230 X
4,786,299 11/1988 DeMarco ..... 181/270 X
5,365,025 11/1994 Kraai et al. ..... 181/252 X

*Primary Examiner*—Khanh Dang
*Attorney, Agent, or Firm*—Michael M. Gnibus

[57] ABSTRACT

A muffler for use with a pneumatic motor the muffler including a housing having a first longitudinal wall, a second longitudinal wall, a first lateral wall, a second lateral wall, and a front wall where the first and second longitudinal walls include an exhaust port and the front, longitudinal and lateral walls define a muffler chamber. The muffler also includes first and second baffle located in said muffler chamber. The first and second baffles include a first side and a second side, and each baffle extends away from a first lateral wall substantially parallel to the longitudinal walls and terminates in a baffle edge. The first and second baffles dividing the muffler chamber into at least two exhaust chambers, the baffle edges define a crossover opening for flowing an exhausted fluid to an adjacent exhaust chamber. A sound absorbing media along said first and second sides of said first and second baffles.

11 Claims, 3 Drawing Sheets

MUFFLER FOR PNEUMATIC DEVICE

FIELD OF THE INVENTION

This invention generally relates to a muffler for a pneumatic device, and more particularly to an improved muffler for a pneumatic device wherein the muffler includes a housing defining a muffler chamber, at least one baffle dividing the chamber into at least two exhaust chambers, and a sound absorbing means included along each of the at least one baffles.

DESCRIPTION OF THE PRIOR ART

Pneumatic devices such as pneumatic motors and tools operate at relatively high noise levels. It is common for known conventional pneumatic devices to operate at noise levels of 80 db or higher. It is therefore desirable to develop a means for reducing the operating noise levels of pneumatic devices.

In an effort to reduce the operating noise levels of known pneumatic devices, mufflers comprising a housing and a porous material located in the housing are flow connected directly to the exhaust ports of known pneumatic devices. As the air is exhausted from the device, it is flowed into the muffler and through the porous material. However, the porous material impedes the outward flow of the exhausted air. The exhausted air is not easily and effectively flowed through the porous material and as a result, a back pressure develops at the exhaust port. The back pressure greatly reduces the efficiency of the associated pneumatic device.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a muffler for a pneumatic device, the muffler including a housing having a first longitudinal wall, a second longitudinal wall, a first lateral wall, a second lateral wall, and a front wall where the first and second longitudinal walls each include an exhaust port and the front, longitudinal and lateral walls define a muffler chamber. The muffler also includes first and second baffles located in said muffler chamber. The first and second baffles include a first side and a second side, and each baffle extends away from a lateral wall substantially parallel to the longitudinal walls and terminates in a baffle edge. The first and second baffles divide the muffler chamber into at least two exhaust chambers. The baffle edges define at least one crossover opening for flowing an exhausted fluid from one chamber to one of the other chambers. A sound absorbing medium is included along said first and second sides of said first and second baffles.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 3:
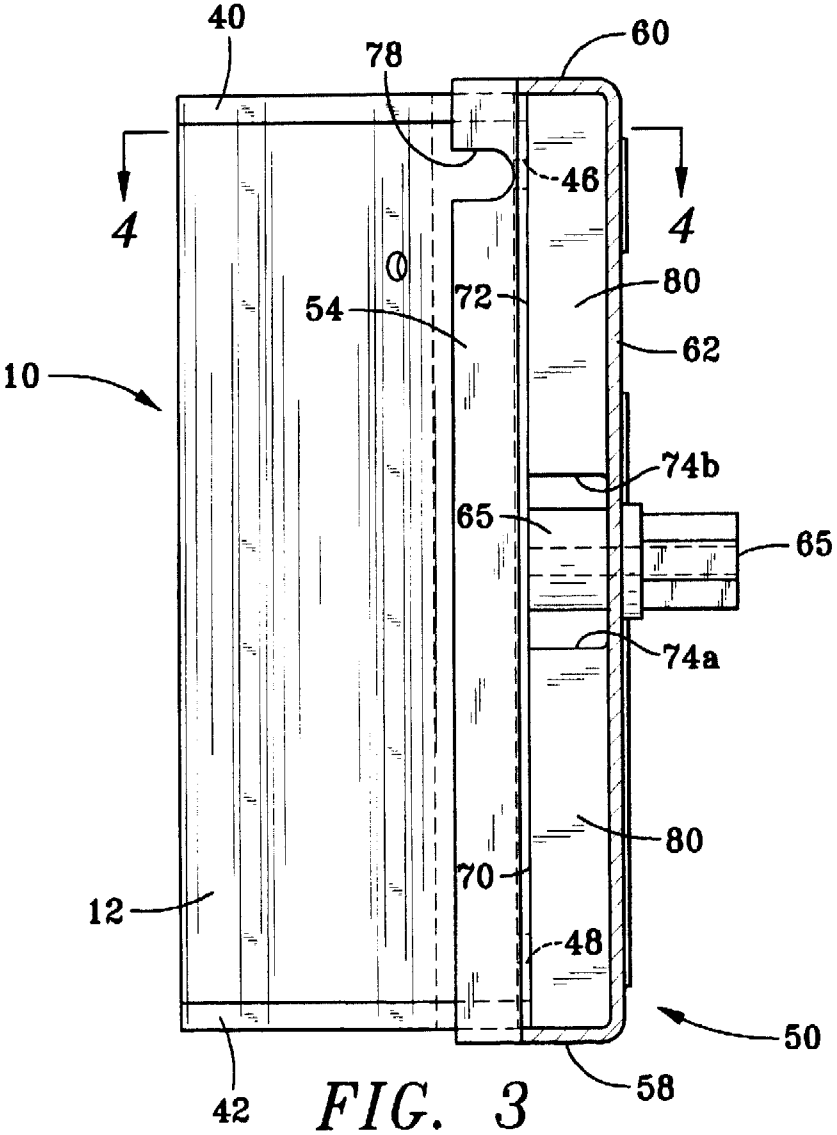
FIG. 3 is a longitudinal sectional view of the muffler of the present invention, taken along line 3—3 of FIG. 4, showing the muffler flow connected to a pneumatic device.
Figure 5:
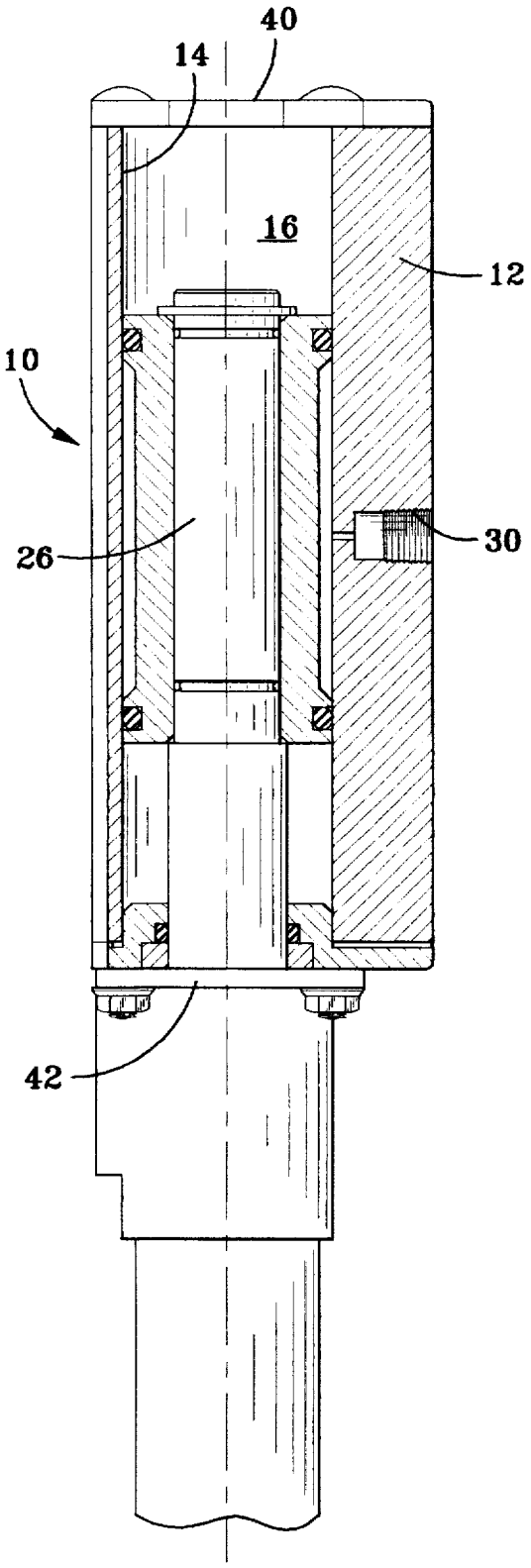
FIG. 5 (PRIOR ART)
FIG. 5 is a sectional view taken along the longitudinal axis of the pneumatic device generally showing the valves of the pneumatic device in the device housing.
Figure 6:
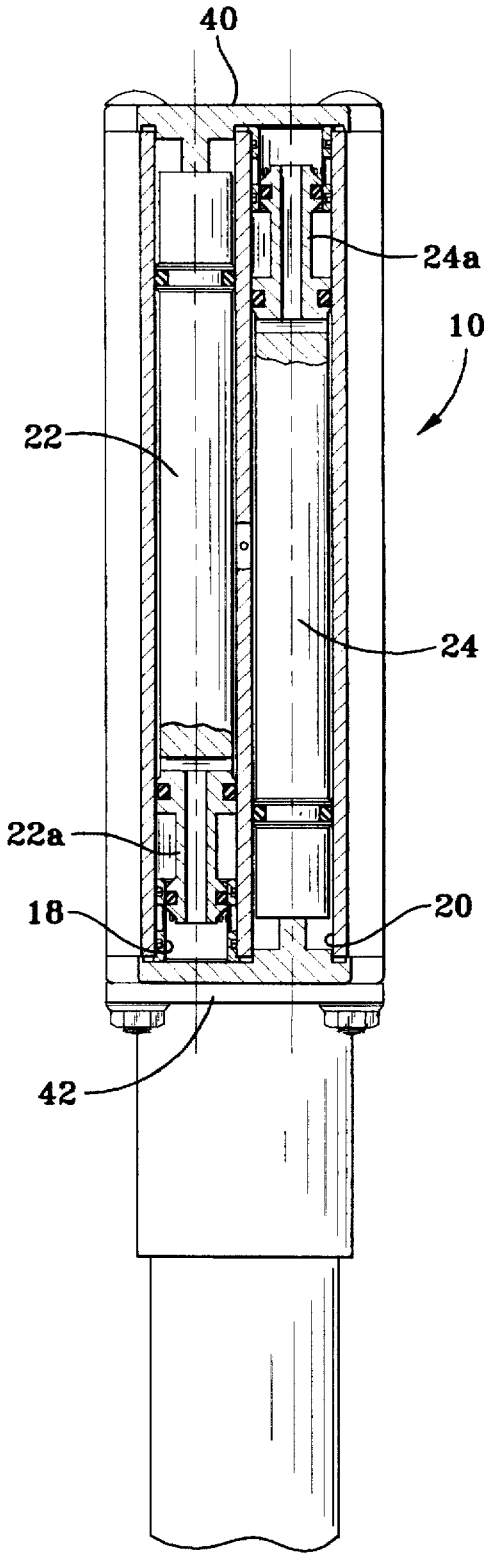
FIG. 6 (PRIOR ART)
FIG. 6 is a sectional view taken along the longitudinal axis of the pneumatic device showing a main piston located in the device housing.

Referring now to the drawings, wherein similar reference characters designate corresponding parts throughout the several views, FIG. 3 shows a pneumatic device generally indicated at 10 with the muffler 50 of the present invention mounted along the exterior of the device housing 12 in exhausted fluid receiving communication with device 10. The pneumatic device may be any known pneumatic device however, for purposes of describing the preferred embodiment of the invention, device 10 is a pneumatic motor like the pneumatic motor described in issued U.S. Pat. No. 5,586,480, the description and operation thereof is incorporated herein by reference and in summary may be considered as follows:

Device 10 includes a housing 12 which includes a cylindrical main piston bore 14 which defines a piston chamber 16 and a pair of valve bores 18 and 20 located side-by-side along one side of chamber 16. Spool valve members 22 and 24 with valve ends **22*a* and 24*a*, are adapted for movement through bores 18 and 20 respectively and piston 26 is adapted for movement through piston chamber 16**. The piston is movable in a reciprocating manner in the main chamber in response to movement by the valve spools.

A main supply port 30 is formed in housing 12 and extends laterally through the housing. A pressurized fluid, such as compressed air is flowed from a compressor or other source of pressurized fluid through the inlet 30 to the valve chambers to move the spool valve members 22 and 24 and main piston 16 through their respective chambers. The walls of the inlet are threaded or otherwise adapted to be flow connected to a connector or adapter at the end of a pressurized fluid supply line or other supply means.

The housing 12 is closed at the ends by first and second end caps 40 and 42.

Exhaust ports 46 and 48 associated with chambers 20 and 18 are provided in the housing 12. As shown in FIG. 3, exhaust port 46 is located adjacent endcap 40 and exhaust port 48 is located adjacent endcap 42. Pressurized fluid supplied to the valve chambers 20 and 18 is exhausted out of the ports 46 and 48 as the valve ends **24*a* and 22*a* are moved through the valve chamber toward endcaps 40 and 42**.

By moving the spool valves in a reciprocating manner in chambers 18 and 20 air is supplied and exhausted from main chamber 16 and in this way the main piston 26 is moved in a reciprocating manner through chamber 16.

Figure 1:
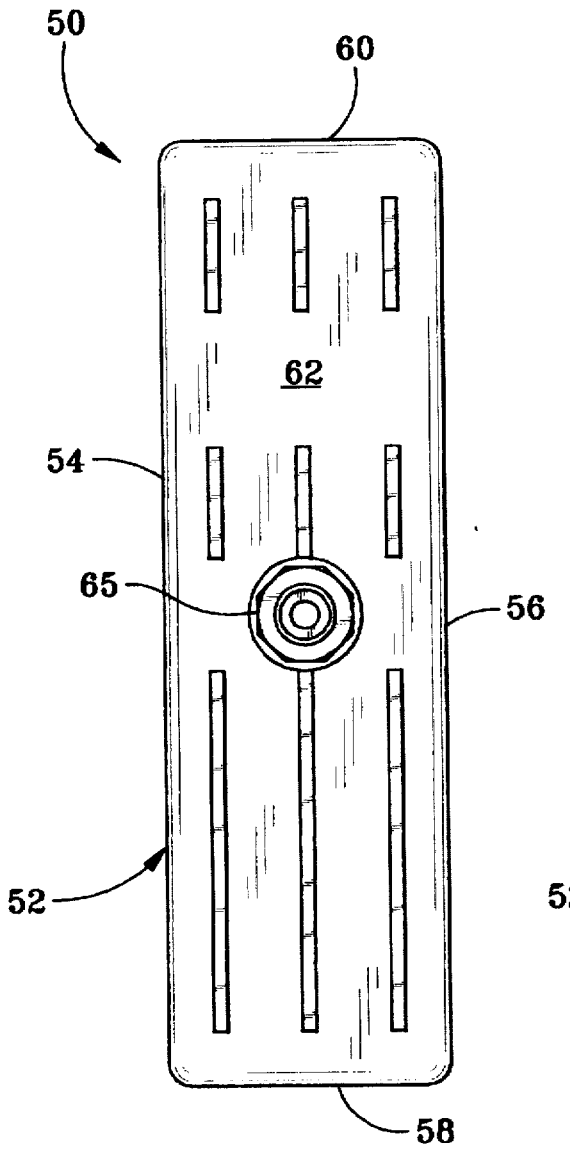
FIG. 1 is a front elevational view of the muffler of the present invention.
Figure 2:
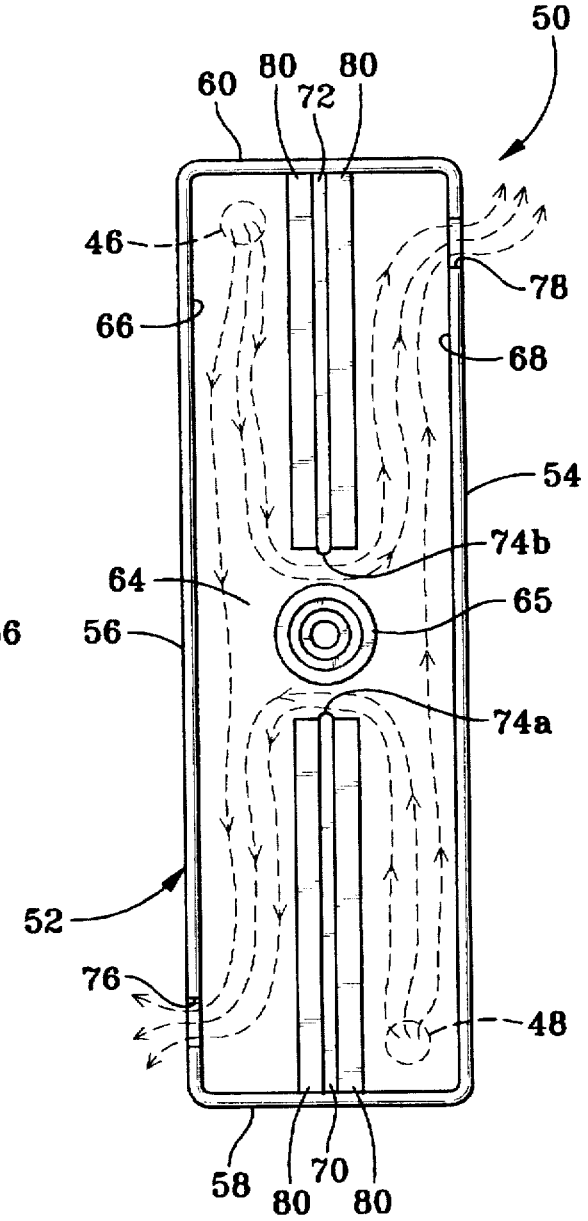
FIG. 2 is a rear elevational view of the muffler of FIG. 1.
Figure 4:
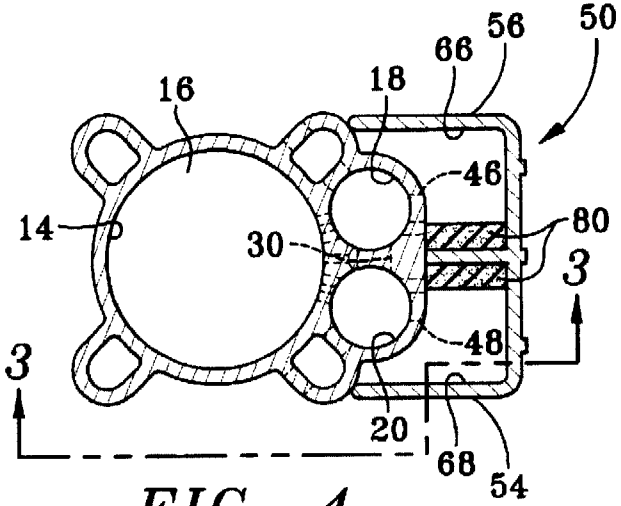
FIG. 4 is a lateral sectional view taken along line 4—4 of FIG. 3.

Now turning to the present invention, fluid exhausted out of device exhaust ports 46 and 48 is flowed into a muffler generally referred to at 50 in FIG. 1. The muffler is in exhaust fluid receiving communication with device 10 and reduces the operating noise levels of the device without producing a back pressure.

The muffler generally includes a muffler housing 52 having first and second longitudinal walls, 54 and 56; first and second lateral walls 58 and 60 which join the longitudinal walls; and front wall 62. In this way, the muffler has substantially closed sides and front and an open back.

The front wall, longitudinal walls and lateral walls define a main muffler chamber 64. An opening is provided in front wall 62 and is adapted to permit a conventional connector 65, well known to one skilled in the art, to be located in the opening. As shown in FIG. 3, when the connector is located in the opening, a portion of the connector body is located in muffler chamber 64 and a portion is located along the housing exterior. The portion located in the muffler chamber is flow connected to a conventional fitting (not shown) seated in the device inlet 30 and the portion located along the exterior may be flow connected to a pressurized fluid supply line such as a conduit or hose. In this way, a pressurized fluid such as air is supplied through the connector 65 to the motor 10.

The muffler chamber is divided into two adjacent exhaust chambers 66 and 68 by first baffle 70 and second baffle 72 located in the chamber. As shown in FIG. 1, the baffles 70 and 72 extend from respective lateral walls 58 and 60 substantially parallel to the longitudinal walls, toward the portion of connector 65 located in chamber 64. Each of the baffles terminates at a free edge proximate the center of the muffler chamber. Crossover openings **74*a* and 74*b* are defined between the connector 65 and the free edges of baffles 70 and 72. The crossover openings permit fluid exhausted into either chamber 66 or 68** to crossover to and flow through the adjacent chamber and out the muffler. In this way, the exhausted fluid can take "the path of least resistance" out of the muffler chamber.

Fluid is exhausted from chamber 66 through port 76 formed in longitudinal side 56 adjacent lateral side 58 and fluid is exhausted from chamber 68 through port 78 formed in longitudinal side 54 adjacent lateral side 60. As shown in FIG. 1, the location of the exhaust ports of device 10 relative to ports 78 and 76 are shown in dashed font and referred to as 46 and 48. The chamber exhaust ports 76 and 78 and associated exhaust ports 46 and 48 respectively are located at the opposite ends of exhaust chambers 66 and 68. See FIG. 1. Substantially all of the fluid exhausted out of device exhaust port 48 is exhausted out port 78 and substantially all of the fluid exhausted out device exhaust port 46 is exhausted out port 76. As the exhausted fluid is flowed toward the respective port 76, 78, a volume of the fluid exhausted out of device ports 46 and 48 crosses over to the adjacent chamber 68 and 66 through crossover openings **74*a* and 74*b*, and is exhausted out the exhaust port for the respective adjacent chamber. Exemplary flow paths of the exhausted fluid are shown by dashed font arrows in FIG. 1**.

As shown in FIG. 1, both sides of the baffles 70 and 72 are covered with a layer of a sound absorbing media 80, preferably, an acoustic foam. The sound absorbing media is fixed to the baffles by an adhesive substance that is applied to the media. However, the foam may be fixed to the baffles in any known, conventional manner. The exterior of each section of the sound absorbing media may be covered by a relatively thin layer of aluminum which protects the foam from ice punctures or other damage by ice formed during motor operation. Although the sound absorbing media is shown covering baffles 70 and 72 it should be understood that the media may be fixed to the longitudinal and lateral walls 54, 56, 58 and 60, and front wall 62. However, since the fluid exhausted from motor 10 tends to flow adjacent the baffles, it has been determined the most effective location for the sound absorbing medium is along the sides of the baffles.

Operation of the Muffler 50 will now be Described.

Before operating pneumatic device 10, the muffler is flow connected to the inlet 30 of device 10 at the portion of connector 65 located in muffler chamber 64. The connector is fastened to the inlet until the exterior edges of the lateral and longitudinal walls and baffles, abut housing 12. In FIG. 3, the longitudinal sides and baffle 72 are shown in abutment with housing 12. In this way, fluid exhausted from chambers 18 and 20 into chambers 68 and 66 is only flowed to the adjacent chamber by crossover openings **74*a* and 74*b*. Once the muffler is in place, a source of pressurized fluid is flow connected to the exterior portion of connector 65, and the fluid is supplied to the spool valve chambers 18 and 20 and the valves 22 and 24** are moved in a reciprocating manner through the chambers.

The fluid in the chambers 18 and 20 is alternatingly exhausted from the device 10 so that when fluid is exhausted out port 46 it is not being exhausted out port 48, and alternatively, when fluid is exhausted out port 48 it is not exhausted out port 46.

The fluid exhausted out port 46 is flowed into chamber 66 and substantially all of the exhausted fluid is flowed out port 76. Some of the fluid flows through crossover openings **74*a* and 74*b* and out port 78. Fluid exhausted out port 48 is flowed into chamber 68 and substantially all of the exhausted fluid is flowed out port 78. Some of the fluid flows through crossover openings 74*a* and 74*b* and out port 76**.

In each instance, as the fluid is exhausted out of the respective exhaust port 46, 48 of device 10, the fluid is flowed against sound absorbing media 80 and the noise produced by the exhausted fluid is absorbed by the media. The fluid is not flowed through the media. Thus, device 10 produces less noise during operation and backflow in the pneumatic device is eliminated by the muffler 50.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A muffler, comprising:

a) housing comprising a first longitudinal wall, a second longitudinal wall, a first lateral wall and a second lateral wall, and a front wall; said front, longitudinal and lateral walls defining a muffler chamber;

b) a first baffle located in said muffler chamber, said first baffle including a first side and a second side, said first baffle extending away from said first lateral wall substantially parallel to said longitudinal walls and terminating in a first baffle edge;

c) a second baffle located in said muffler chamber, said second baffle including a first side and a second side, said second baffle extending away from said second lateral wall substantially parallel to said longitudinal walls and terminating in a second baffle edge, said first and second baffles dividing the muffler chamber into at least two exhaust chambers, said first and second edges defining at least one crossover opening for flowing an exhausted fluid between exhaust chambers; and d) a sound absorbing media along said first and second sides of said first and second baffles.

2. The muffler as claimed in claim 1 wherein the first and second longitudinal walls each include an exhaust port adjacent a lateral wall.

3. The muffler as claimed in claim 2 wherein the exhaust port along the first longitudinal wall is located adjacent the first lateral wall and the exhaust port along the second longitudinal wall is located adjacent the second lateral wall.

4. The muffler as claimed in claim 1 wherein the front wall includes an opening, the muffler further comprising a connector inserted through the opening in the front wall so that a portion of the connector is located in the muffler chamber, the muffler including two crossover openings, each opening defined by a baffle edge and the portion of the connector located in the muffler chamber.

5. The muffler as claimed in claim 1 wherein there are two substantially parallel exhaust chambers.

6. A combination comprising:

I. a pneumatic device actuated by a fluid comprising a device housing having at least one exhaust port for exhausting the fluid; and II. a muffler in fluid receiving communication with said pneumatic device, said muffler comprising:

a) a housing comprising a first longitudinal wall, a second longitudinal wall, a first lateral wall and a second lateral wall, and a front wall; said front, longitudinal and lateral walls defining a muffler chamber;

b) a first baffle located in said muffler chamber, said first baffle including a first side and a second side, said first baffle extending away from said first lateral wall substantially parallel to said longitudinal walls and terminating in a first baffle edge;

c) a second baffle located in said muffler chamber, said second baffle including a first side and a second side, said second baffle extending away from said second lateral wall substantially parallel to said longitudinal walls and terminating in a second baffle edge, said first and second baffles dividing the muffler chamber into at least two exhaust chambers, said first and second edges defining a crossover opening for flowing the exhausted fluid to an adjacent chamber; and d) a sound absorbing media along said first and second sides of said first and second baffles.

7. The combination as claimed in claim 6 wherein the pneumatic device is a motor, having two exhaust ports.

8. The combination as claimed in claim 6 wherein the longitudinal walls include muffler exhaust ports.

9. The combination as claimed in claim 6 wherein the first and second longitudinal walls include a single exhaust port with the exhaust ports located along the first and second longitudinal walls near one of the lateral walls.

10. A muffler for a pneumatic device, the muffler comprising: a housing defining a muffler chamber, said housing including first and second lateral walls and first and second longitudinal walls, at least two baffles dividing the muffler chamber into at least two exhaust chambers, each of the at least two baffles having a first edge made integral with one of the first and second lateral sides, each of the two baffles extending parallel to the first and second longitudinal sides and terminating at a free edge located in the muffler chamber, said free edges defining a crossover passage; said muffler further comprising a noise absorbing means included along each of the at least two baffles.

11. The muffler for a pneumatic device as claimed in claim 10 wherein each of the at least two baffles has two sides, the noise absorbing means being included along both sides of the at least two baffles.

* * * * *